United States Patent [19]

Fraser, Jr. et al.

[11] Patent Number: 4,917,582

[45] Date of Patent: Apr. 17, 1990

[54] HORIZONTAL SCROLL COMPRESSOR WITH OIL PUMP

[75] Inventors: Howard H. Fraser, Jr., Lafayette; Thomas L. Kassouf, Syracuse, both of N.Y.

[73] Assignee: Carrier Corporation, Syracuse, N.Y.

[21] Appl. No.: 315,982

[22] Filed: Feb. 27, 1989

[51] Int. Cl.[4] ..... F04C 18/04; F04C 29/02

[52] U.S. Cl. ..... 418/55; 418/88; 418/96

[58] Field of Search ..... 418/55 B, 55 E, 88, 418/94, 96; 184/6.16

[56] References Cited

U.S. PATENT DOCUMENTS

| | | | |
|---|---|---|---|
| 4,129,405 | 12/1978 | McCullough | 418/88 |
| 4,385,875 | 5/1983 | Kanazawa | 418/63 |
| 4,544,338 | 10/1985 | Takebayashi et al. | 418/63 |
| 4,561,829 | 12/1985 | Iwata et al. | 417/368 |
| 4,568,253 | 2/1986 | Wood | 417/372 |
| 4,626,180 | 12/1986 | Tagawa et al. | 418/63 |
| 4,637,786 | 1/1987 | Matoba et al. | 418/55 B |
| 4,712,986 | 12/1987 | Nissen | 418/63 |
| 4,781,542 | 11/1988 | Ozu et al. | 417/369 |
| 4,818,198 | 4/1989 | Tamura et al. | 418/55 E |

FOREIGN PATENT DOCUMENTS

| | | | |
|---|---|---|---|
| 59-60092 | 4/1984 | Japan | 418/55 E |
| 59-120796 | 7/1984 | Japan | 418/55 E |
| 62-113880 | 5/1987 | Japan | 418/94 |

*Primary Examiner*—John J. Vrablik

*Attorney, Agent, or Firm*—David J. Zobkiw

[57] ABSTRACT

A hermetic horizontal scroll compressor uses the motion of the Oldham coupling to pump oil from the sump to a lubrication distribution system for the scroll compressor.

6 Claims, 4 Drawing Sheets

HORIZONTAL SCROLL COMPRESSOR WITH OIL PUMP

BACKGROUND OF THE INVENTION

A hermetic scroll compressor is normally in a vertical orientation so that lubrication for the shaft and orbiting scroll bearings, anti-rotation device, thrust surfaces, etc. is, typically, supplied by a passive centrifugal pump incorporated into the drive shaft. Oil is drawn from a sump which is located at the bottom of the compressor shell and enters the pump through an orifice in the bottom of the shaft. The parts requiring lubrication are, normally, no more than a foot or so above the oil level of the sump so that a small increase in the oil pressure due to its radial acceleration is sufficient to supply the oil to the required locations. This relatively simple, passive lubrication system is a primary reason why hermetic scroll compressors are designed to operate in a vertical position. In this orientation, the compressor height-to-diameter ratio is generally two, or more. By comparison, a typical reciprocating compressor of the same capacity has a height-to-diameter ratio of approximately 1.5.

For many applications, the height of the compressor is a primary factor because of packaging considerations. Very often, the height of an air conditioning, refrigeration or heat pump unit is more important than its width or depth. Accordingly, a distinct advantage could be realized if the scroll compressor could be designed to operate in a horizontal orientation. However, in changing the orientation of a hermetic scroll compressor from a vertical to a horizontal orientation, there are significant changes in the lubrication system and gas flow paths. The motor, crankcase, anti-rotation device and scroll members will extend below the level of the oil in the sump although it is not #necessary that all of the members be exposed to the oil sump. The parts to be lubricated are located no more than a few inches above the sump as opposed to a foot, or more, in a vertical unit but the drainage paths are shorter and over different parts. The oil sump blocks some normally used gas paths which are used in cooling the motor and removing entrained oil and some of the drainage paths can contribute to oil entrainment.

SUMMARY OF THE INVENTION

A scroll compressor is horizontally oriented which reduces the height by a half as compared to a vertical unit. Since the oil sump is no longer located at what is now an end, the length of the shell can be reduced by the amount necessary to define the sump and to accommodate the oil pickup tube carried by the crankshaft. Because the crankshaft is no longer acting as a centrifugal pump, the passages used to produce the centrifugal pumping can be simplified and/or eliminated making machining easier and less expensive. The oil pump is of the positive displacement type with the inlet located below the liquid level of the oil sump. The pump is driven by, or is integral with, either the orbiting scroll or the anti-rotation device.

It is an object of this invention to provide a horizontal hermetic scroll compressor.

It is another object of this invention to reduce the cubage of a hermetic scroll compressor.

It is a further object of this invention to reduced the overall height of a hermetic scroll compressor.

It is an additional object of this invention to provide improved lubrication in a hermetic scroll compressor. These objects, and others as will become apparent hereinafter, are accomplished by #the present invention.

Basically, a hermetic scroll compressor is located horizontally thereby permitting a length and cubage reduction corresponding to the oil sump of a vertical unit. With the sump located such that the scroll and anti-rotation structure goes beneath the surface of the oil sump, the motion of the anti-rotation device is employed to drive a positive displacement lubrication pump. The lubricating pump pumps the oil to the interfaces between the anti-rotation device and the fixed and orbiting scroll, to the interface between the orbiting scroll and the crankcase and to the bearings supporting the crankshaft and the bushing between the crankshaft and orbiting scroll.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figure 3:
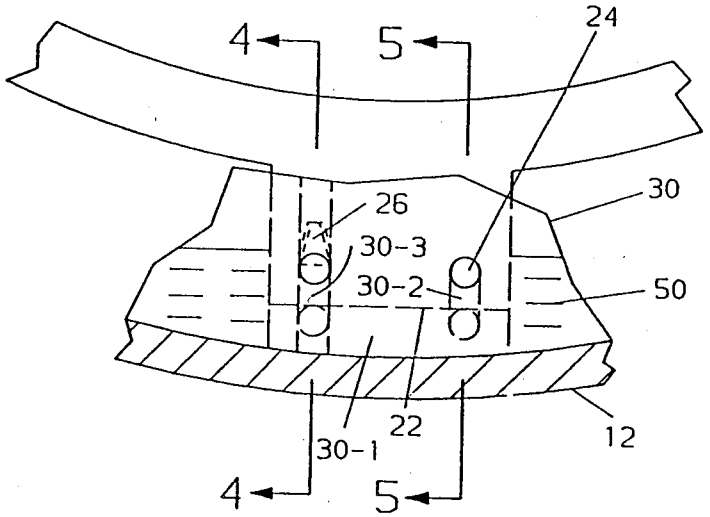
FIG. 3 is an enlarged view of the bottom portion of the crankcase as viewed looking towards the left in FIG. 2.
Figure 1:
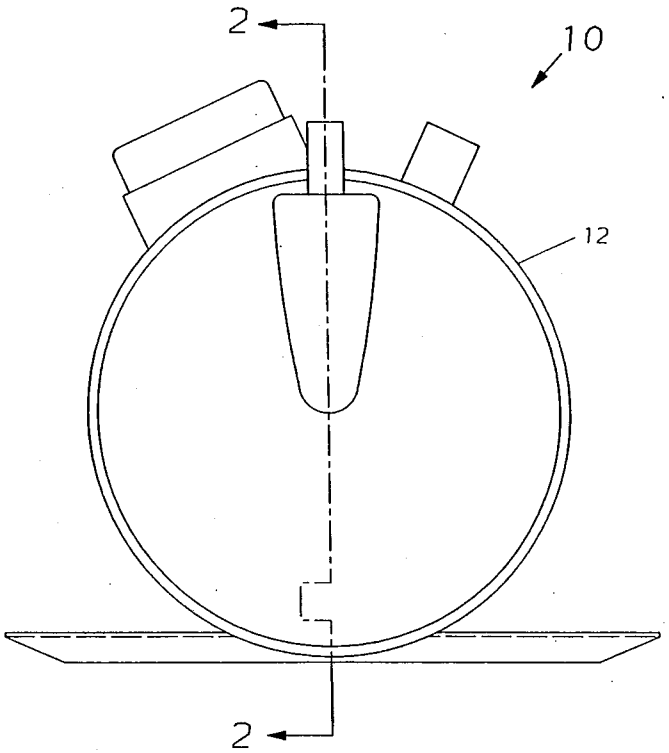
FIG. 1 is an end view of a horizontal scroll compressor.
Figure 2:
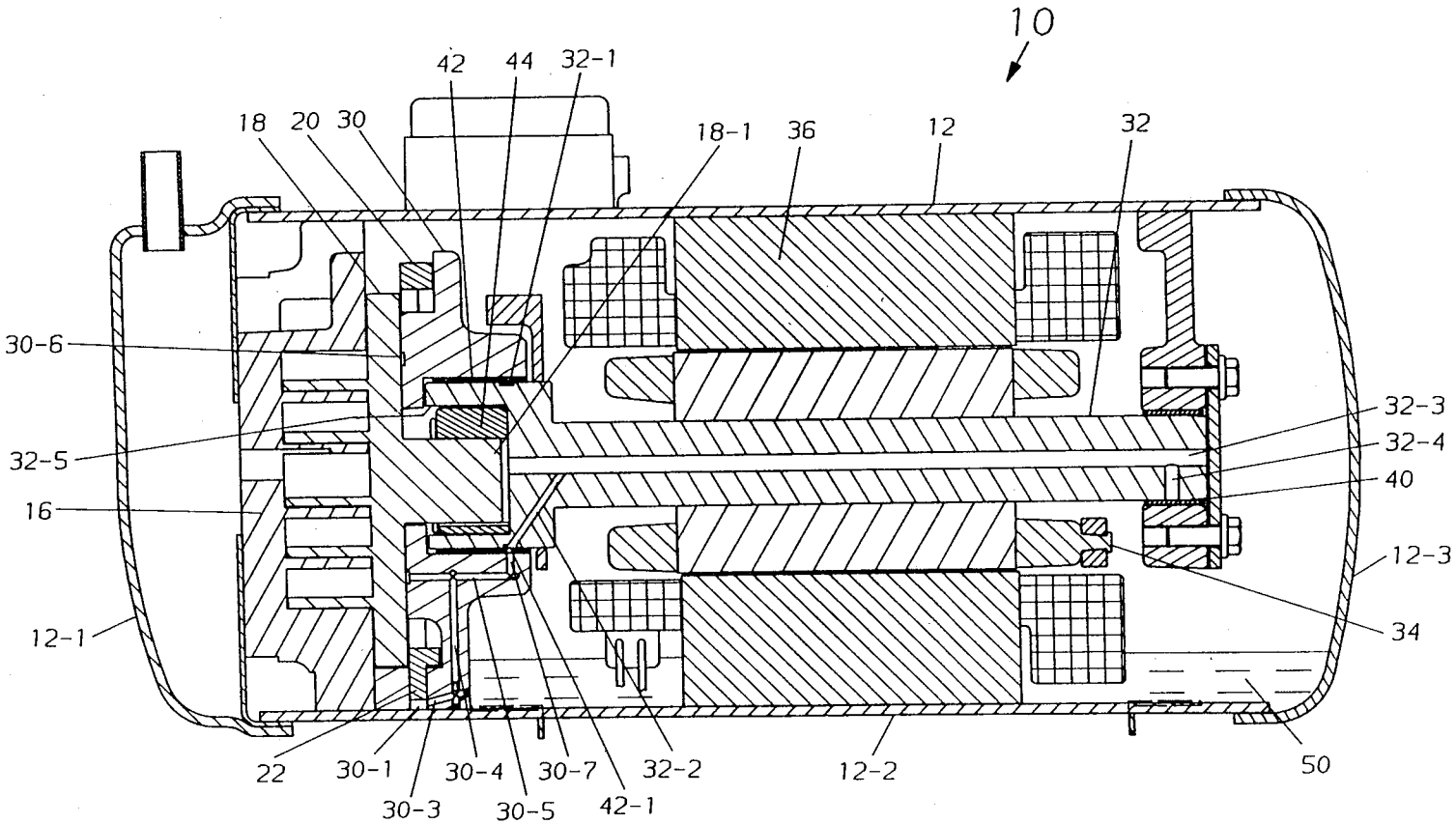
FIG. 2 is a sectional view taken along line 2—2 of FIG. 1.
Figure 5:
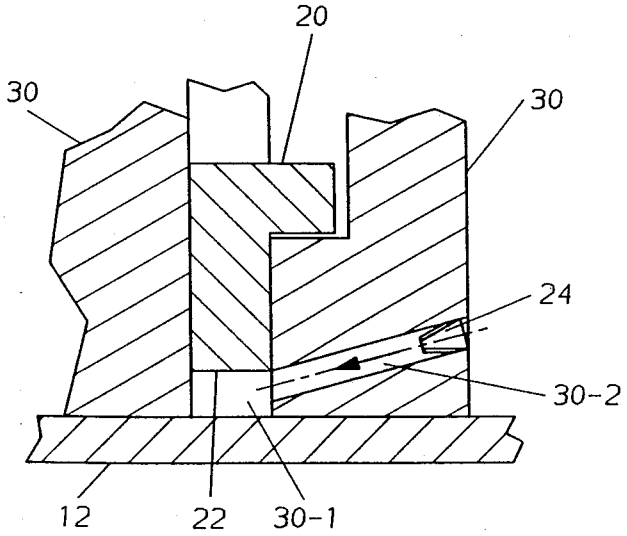
FIG. 5 is a sectional view taken along line 5—5 of FIG. 3.
Figure 4:
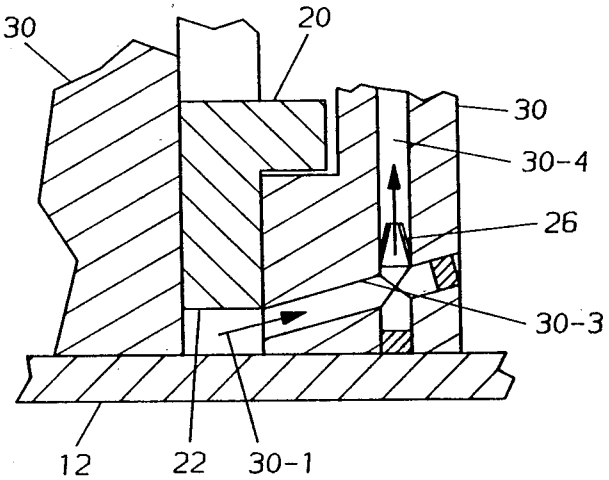
FIG. 4 is a sectional view taken along line 4—4 of FIG. 3.

In FIGS. 1 and 2 the numeral 10 generally designates a low side, horizontal hermetic scroll compressor including a shell 12 made up of end portions 12-1 and 3 which are welded or otherwise suitably joined to middle portion 12-2. A low side compressor is one in which most of the shell is filled with gas at suction pressure. Within shell 12 are fixed scroll member 16, orbiting scroll member 18, anti-rotation device 20 in the form of an Oldham ring or coupling, crankcase 30, crankshaft 32, rotor 34 which is secured to crankshaft 32 and stator 36, as is conventional. Additionally, crankshaft 32 is supported at one end by bearing 40 and is supported at the other end by bearing 42 as well as being connected to boss 18-1 of orbiting scroll 18 via a bushing, sliding block or any other suitable structure 44. The structure so far described is generally that of a vertical hermetic scroll placed horizontally. The first consequence of the changed orientation is the relocation of the oil sump 50 which causes portions of stator 36, crankcase 30, anti-rotation device 20, orbiting scroll 18 and fixed scroll 16 to be located beneath the level of the oil sump although not necessarily directly exposed to the oil in sump 50. A second consequence is the elimination of the need for crankshaft 32 and/or an oil pickup tube (not illustrated) to extend into an oil sump defined by shell member 12-1. As a result, the shell member 12-3 can be placed closer to the end of crankshaft 32 thereby reducing the length of shell 12 and its cubage. Other consequences are changes in the coaction between bearings 40 and 42 with crankshaft 32 since they now bear the weight of the crankshaft 32 and its carried members on one side, the lowest point, and because the crankshaft 32 no longer needs to provide a centrifugal pumping force to the oil to cause it to be pumped.

In a conventional anti-rotation device 20 of the Oldham coupling type, the Oldham coupling reciprocates with respect to the fixed scroll 16. Similarly, the orbiting scroll 18 reciprocates with respect to the Oldham coupling 20 but, since the Oldham coupling is also reciprocating at 90 with respect to the direction of reciprocation of the orbiting scroll 18, the net result is an orbiting motion of orbiting scroll 18 with respect to fixed structure in a shell 12 such as fixed scroll 16. The motion of either the anti-rotation device 20 can be adopted to drive a positive displacement pump according to the teachings of the present invention.

Figure 6:
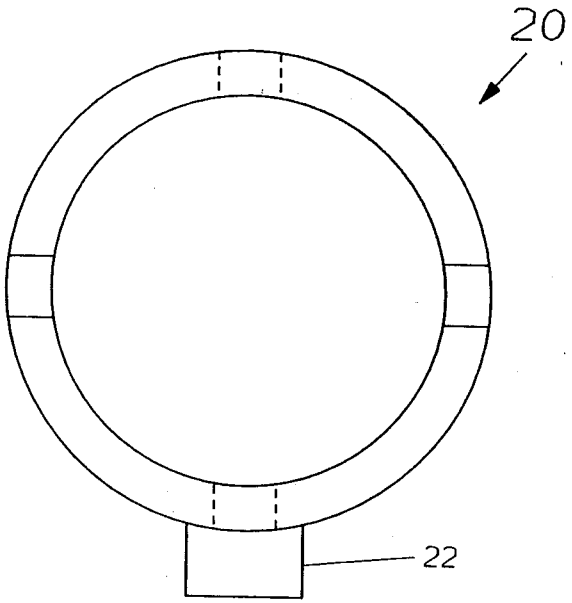
FIG. 6 is a view of the anti-rotation device.

Referring specifically to FIGS. 2 and 6, anti-rotation device 20 is formed as an Oldham coupling which reciprocates vertically with respect to the crankcase 30 and is modified, as compared to a conventional Oldham coupling, by extending the lowermost key 22 so that it defines a piston. Key/piston 22 is reciprocatably received in piston bore 30-1 which is formed in crankcase 30. Bore 30-1 is in fluid communication with oil sump 50 via bore 30-2 and fluid diode 24 which is a device having a different flow resistance in opposite directions of flow such that fluid diode 24 defines the suction port. Similarly, bore 30-1 is in fluid communication with bore 30-3 which is connected to radial bore 30-4 containing fluid diode 26 which defines the discharge port.

Referring now to FIG. 2, radial bore 30-4 intersects with and terminates at axial bore 30-5. One end of axial bore 30-5 terminates at annular groove 30-6 which faces orbiting scroll 18. The other end of bore 30-5 intersects radial bore 30-7. Radial bore 30-7 terminates at radial bore 42-1 which extends through bearing 42. An annular groove 32-1 is formed in crankshaft 32 opposite bore 42-1. An axial bore 32-3 is formed in crankshaft 32 and extends for its length. Bore 32-3 is connected to groove 32-1 via generally radial bore 32-2 and is connected to bearing 40 via radial bore 32-4.

In operation, Oldham coupling 20 reciprocates up and down due to its coaction with crankcase 30 and orbiting scroll 18. As Oldham coupling 20 reciprocates key/piston 22 which is received in and coacts with bore 30-1 drawing oil from the sump 50 via fluid diode 24 and bore 30-2 and discharging it via bores 30-3 and 4 and fluid diode 26 into bore 30-5 at an elevated pressure which is sufficient to feed the oil to any place in the shell 12 without requiring a further pressure boost. Specifically, bore 30-5 is fluidly connected to annular groove 30-6 at the interface between orbiting scroll 18 and crankcase 30. The pressure of the oil is sufficient to fill groove 30-6 and thereby provide #lubrication between the orbiting scroll 18 and crankcase 30. Oil supplied to bore 30-5 also passes via bores 30-7 and 42-1 into groove 32-1 which fills with oil and provides lubrication between bearing 42 and crankshaft 32. A portion of the oil supplied to groove 32-1 is supplied to bore 32-3 via bore 32-2. The oil supplied to bore 32-3 is divided. One portion flows into the cavity defined by bore 32-5 of crankcase 32 which contains boss 18-1 of orbiting scroll 18 and bushing or sliding block 44. The other portion of the oil is supplied to bearing 40 via bore 32-4. Since the oil is only being pumped several inches, theres is no need for a centrifugal boost.

Although a preferred embodiment of the present invention has been illustrated and described, other changes will occur to those skilled in the art. For example, key 22 could have a different cross section such as circular. It is therefore intended that the present invention is to be limited only by the scope of the appended claims.

What is claimed is:

1. In a hermetic horizontal scroll compressor including a shell containing a fixed and an orbiting scroll, a crankcase, a crankshaft extending substantially in the horizontal direction, bearings for supporting said crankshaft, means for driving said crankshaft, an anti-rotation means for limiting said orbiting scroll to orbiting motion and an oil sump, a lubrication system comprising:

means forming a piston bore in fluid communication with sid oil sump;

piston means integral with said anti-rotation means and reciprocatably located in said piston bore;

a lubrication distribution means in fluid communication with said piston bore for delivering oil to lubricate said orbiting scroll, said crankshaft and said bearings whereby when said anti-rotation means is caused to move said piston means reciprocates in said piston bore and thereby pumps oil from said sump to said lubrication distribution means.

2. The lubrication system of claim 1 wherein said piston bore is in fluid communication with said oil sump and said lubrication distribution means via fluid diodes.

3. The lubrication system of claim 1 wherein said piston bore is formed in said crankcase.

4. A hermetic horizontal scroll compressor means comprising:

a shell defining an oil sump;

a fixed and an orbiting scroll, a crankcase, a crankshaft extending substantially in the horizontal direction and anti-rotation means operatively connected within said shell;

bearings supporting said crankshaft;

a vertically extending radial piston bore formed in said crankcase which extends upwardly from said shell;

piston means integral with said anti-rotation means and reciprocatably located in said piston bore;

a lubrication distribution means;

a first fluid path means between said oil sump and said piston bore and defining a suction supply line for supplying oil to said piston bore;

a second fluid path means between said piston bore and said lubrication distribution means and defining a discharge line for supplying oil to said lubrication distribution means;

said lubrication distribution means including means for supplying oil to provide lubrication between said orbiting scroll and said crankcase and to lubricate said bearings.

5. The scroll compressor means of claim 4 wherein said first and second fluid path means contain fluid diodes.

6. The scroll compressor means of claim 4 wherein said lubrication distribution means includes fluid paths in said crankcase for providing said lubrication between said orbiting scroll and said crankcase and for lubricating at least one of said bearings.

* * * * *